US007604524B2

(12) United States Patent
Jung et al.

(10) Patent No.: US 7,604,524 B2
(45) Date of Patent: Oct. 20, 2009

(54) METHOD FOR MANUFACTURING PLASMA DISPLAY PANEL HAVING BARRIER RIBS

(75) Inventors: Bo-Yong Jung, Suwon-si (KR); Tae-Kyoung Kang, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 507 days.

(21) Appl. No.: 11/217,437

(22) Filed: Sep. 2, 2005

(65) Prior Publication Data

US 2006/0061278 A1 Mar. 23, 2006

(30) Foreign Application Priority Data

Sep. 20, 2004 (KR) ..... 10-2004-0075021

(51) Int. Cl.
*H01J 9/24* (2006.01)

(52) U.S. Cl. ..... 445/24; 313/586

(58) Field of Classification Search ..... 313/582, 313/586, 609, 610; 445/24, 25
See application file for complete search history.

(56) References Cited

U.S. PATENT DOCUMENTS

| | | | | |
|---|---|---|---|---|
| 5,776,545 | A * | 7/1998 | Yoshiba et al. | 427/64 |
| 6,184,621 | B1 * | 2/2001 | Horiuchi et al. | 445/24 |
| 6,623,325 | B2 * | 9/2003 | Tsuruoka et al. | 445/24 |
| 6,878,333 | B1 * | 4/2005 | Yokoyma et al. | 264/494 |
| 7,125,584 | B2 * | 10/2006 | Ito | 427/424 |
| 7,176,492 | B2 * | 2/2007 | Chiu | 445/24 |
| 2003/0048070 | A1 * | 3/2003 | Yabe | 313/495 |
| 2003/0117072 | A1 * | 6/2003 | Yabe | 313/609 |
| 2004/0091607 | A1 * | 5/2004 | Ito | 427/96 |
| 2004/0164662 | A1 * | 8/2004 | Cho et al. | 313/292 |
| 2008/0143236 | A1 * | 6/2008 | Murakami et al. | 445/24 |

FOREIGN PATENT DOCUMENTS

| | | | |
|---|---|---|---|
| JP | 11339668 | | 12/1999 |
| JP | 2000048714 | | 2/2000 |
| JP | 2001126615 | A * | 5/2001 |
| JP | 2003-086089 | | 3/2003 |
| JP | 2004-079478 | | 3/2004 |
| JP | 2004-105799 | | 4/2004 |
| JP | 2004-184800 | | 7/2004 |
| KR | 2000-0068835 | | 11/2000 |

* cited by examiner

*Primary Examiner*—Peter Macchiarolo
(74) *Attorney, Agent, or Firm*—H.C. Park & Associates, PLC

(57) ABSTRACT

A plasma display panel includes a first substrate and second substrate opposing each other, address electrodes arranged on the first substrate along a first direction, barrier ribs arranged between the first substrate and the second substrate to define a plurality of discharge cells, and display electrodes arranged on the second substrate along the second direction intersecting the first direction. The barrier ribs include dummy barrier ribs arranged in a non-display region provided in the first substrate and the second substrate, the dummy barrier ribs satisfying the following formula:

$$2.4 \leq (h/l) \times 100 \leq 6.0$$

where l is a length of a dummy barrier rib measured in the first direction, and h is a height of a barrier rib measured in a thickness direction of the panel.

13 Claims, 6 Drawing Sheets

METHOD FOR MANUFACTURING PLASMA DISPLAY PANEL HAVING BARRIER RIBS

CROSS REFERENCE TO RELATED APPLICATION

This application claims priority to and the benefit of Korean Patent Application No. 10-2004-0075021, filed on Sep. 20, 2004, which is hereby incorporated by reference for all purposes as if fully set forth herein.

BACKGROUND OF THE INVENTION

1. Field of the Invention

The present invention relates to a plasma display panel, and more particularly, to barrier ribs of a plasma display panel and a method for manufacturing the same.

2. Description of the Background

Generally, a plasma display panel (PDP) displays images using gas discharge to generate ultraviolet rays, which excite phosphors to emit visible light. The PDP may be made with a screen that is greater than 60 inches, and it may be less than 10 centimeters (cm) thick. Additionally, since the PDP is self-emissive, like a cathode ray tube (CRT), it exhibits satisfactory color reproduction undistorted by viewing angle.

Furthermore, its manufacturing process is simpler than that of a liquid crystal display (LCD). Hence, the PDP may be easier and cheaper to produce than an LCD. Accordingly, the PDP is experiencing increasing popularity.

While many PDP structures have been suggested, a three-electrode surface discharge PDP is a very common structure. A three-electrode surface discharge PDP includes a first substrate having a pair of electrodes, a second substrate spaced apart from the first substrate and having address electrodes, and a plurality of discharge cells defined by barrier ribs between the first and second substrates.

Known techniques for forming a PDP's barrier ribs include a screen printing method, a sand blast method, and so on.

With the screen printing method, a patterned screen is placed on a substrate with a predetermined gap maintained between the screen and the substrate. A barrier rib substance is then compressed, transferred and printed on the substrate in a desired pattern. The screen printing method, however, involves a complicated process to acquire a barrier rib having a height dimension as requested in a PDP.

With the sand blast method, rib paste is coated on a substrate and an abrasive is then sprayed thereon, thereby forming the barrier ribs having a predetermined pattern. More specifically, forming the barrier ribs includes coating a rib paste on an entire surface of a substrate to form a barrier rib layer, laminating resist on the barrier rib layer, patterning the resist through photo-exposure and developing processes, removing the exposed rib paste by applying an abrasive, removing the resist, and annealing the rib paste forming the barrier rib pattern.

As described above, conventional methods for manufacturing barrier ribs involve several processing steps, thereby complicating the process and reducing manufacturing efficiency.

A PDP has a display region and a non-display region, and image display substantially occurs in the display region. The non-display region, where images are not displayed, encompasses a dummy region and terminal regions connecting electrodes within the PDP and external terminals. Dummy cells are arranged in the dummy region. The dummy region structurally supports the discharge cells formed in the display region so that they may have substantially uniform discharge or emissive characteristics.

Accordingly, a PDP that optimizes a barrier rib in the dummy region is needed.

SUMMARY OF THE INVENTION

The present invention provides a plasma display panel (PDP) that may permit a simplified process for manufacturing barrier ribs, and a method of manufacturing the PDP.

The present invention also provides a PDP capable of increasing uniformity of barrier ribs formed in a display region by a dummy barrier rib design, and a method of manufacturing the PDP.

Additional features of the invention will be set forth in the description which follows, and in part will be apparent from the description, or may be learned by practice of the invention.

The present invention discloses a plasma display panel including a first substrate and a second substrate opposing each other, address electrodes arranged on the first substrate along a first direction, barrier ribs arranged between the first substrate and second substrate to define a plurality of discharge cells, and display electrodes arranged on the second substrate along a second direction intersecting the first direction, wherein the barrier ribs include dummy barrier ribs arranged in a non-display region provided in the first substrate and the second substrate, the dummy barrier ribs being formed to satisfy the following formula:

$$2.4 \leq (h/l) \times 100 \leq 6.0$$

where l is a length of a dummy barrier rib measured in the first direction, and h is a height of a barrier rib measured in a thickness direction of the panel.

The present invention also discloses a method of manufacturing a plasma display panel having discharge cells defined by barrier ribs between a first substrate and a second substrate opposing each other, and address electrodes and display electrodes corresponding to respective discharge cells, includes forming the barrier ribs on the first substrate, wherein forming a barrier rib includes preparing rib paste, forming a rising portion and a flat portion using a dispenser that discharges the rib paste while moving above the first substrate, and drying and firing the rising portion and the flat portion It is to be understood that, both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
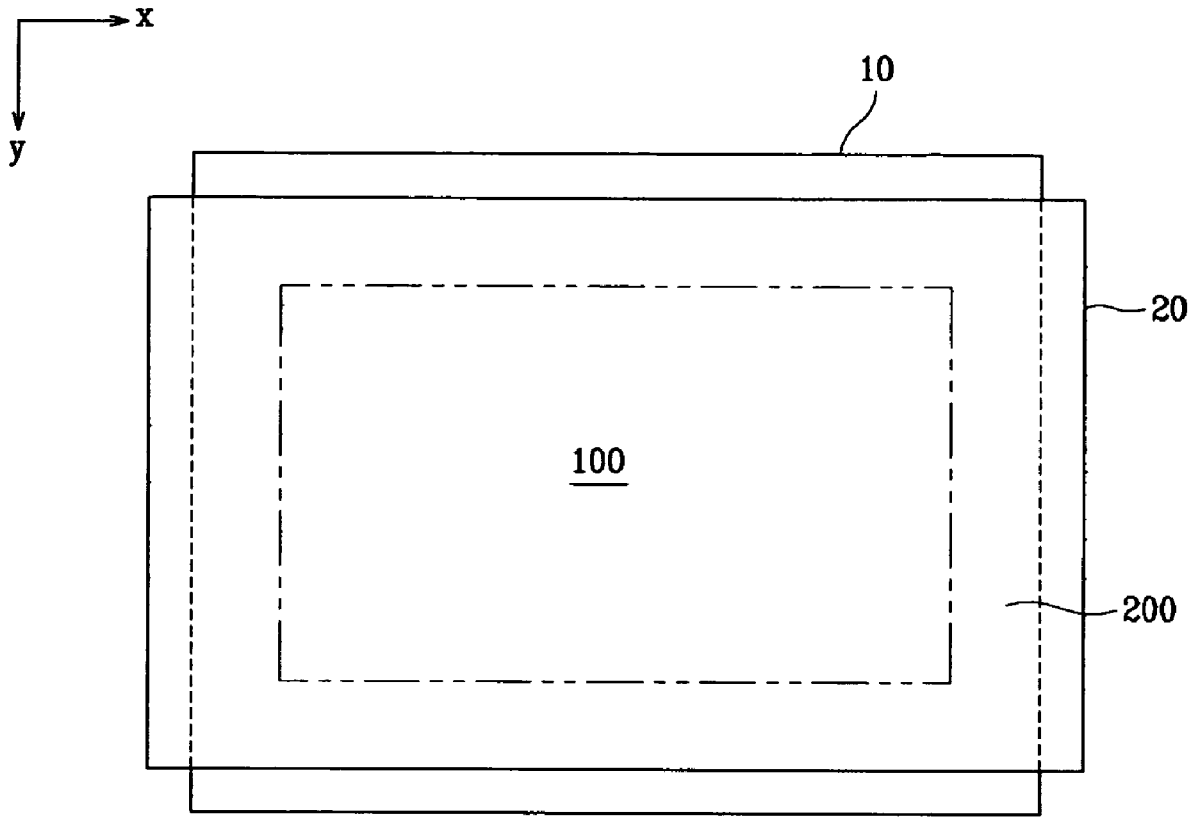
FIG. 1 is a plan view showing a plasma display panel (PDP) according to a first exemplary embodiment of the present invention.

Referring to FIG. 1, a plasma display panel (PDP) according to a first exemplary embodiment of the present invention includes a first substrate 10 (rear substrate) and a second substrate 20 (front substrate) arranged substantially parallel to each other with a predetermined gap therebetween. The rear and front substrates 10 and 20 are combined with each other, thereby forming a basic structure of the PDP.

A display region 100 and a non-display region 200, which is located outside the display region 100, are provided on the rear substrate 10 and the front substrate 20. Images are displayed in the display region 100. That is, discharge cells are arranged within the display region 100 to display images. The non-display region 200 includes a dummy region, in which barrier ribs defining dummy cells and dummy cells are arranged, and terminal regions, which couple electrodes within the PDP with external terminals. The non-display region 200 does not display images.

Figure 2:
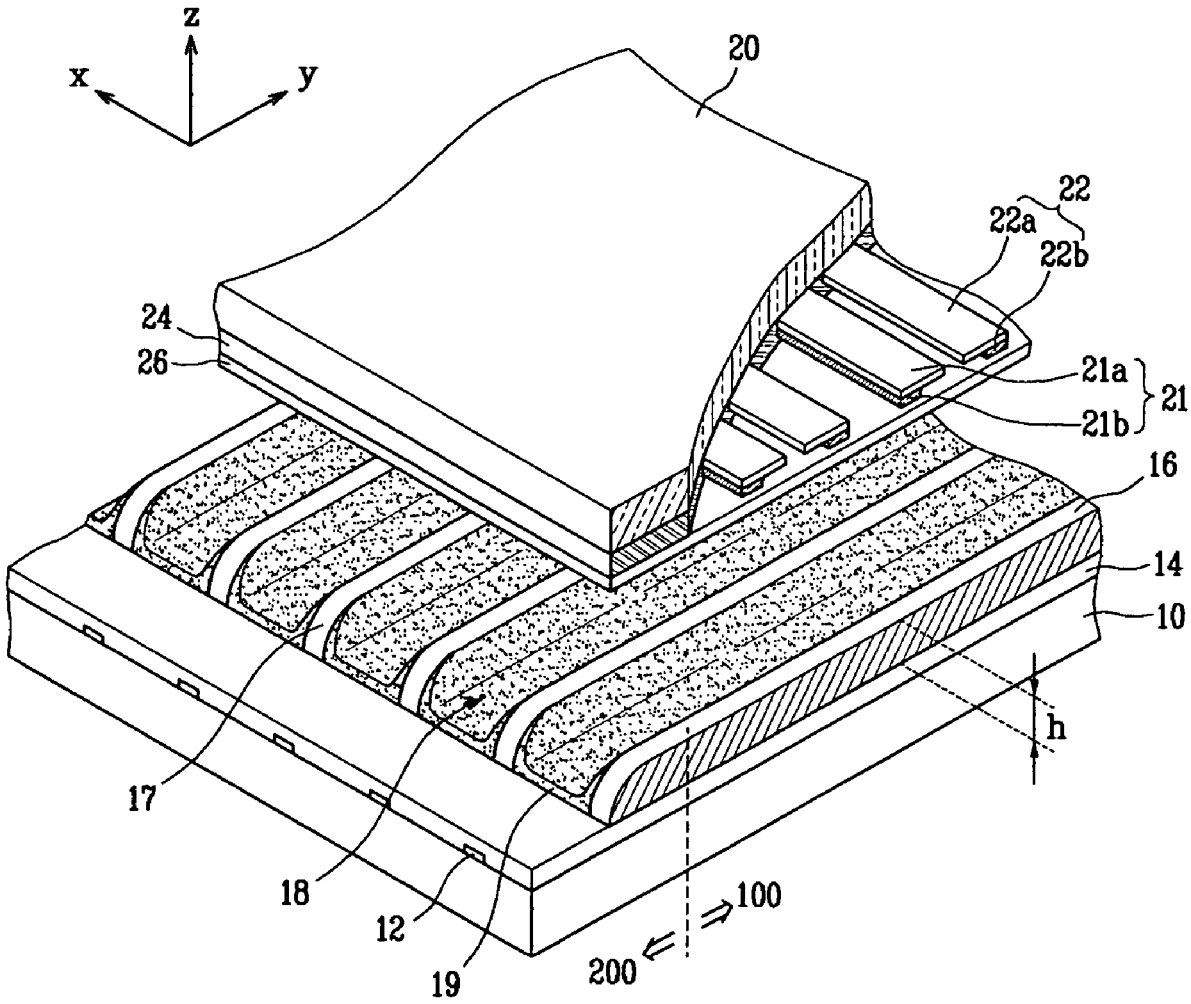
FIG. 2 is a partially exploded perspective view showing the PDP according to the first exemplary embodiment of the present invention.
Figure 3:
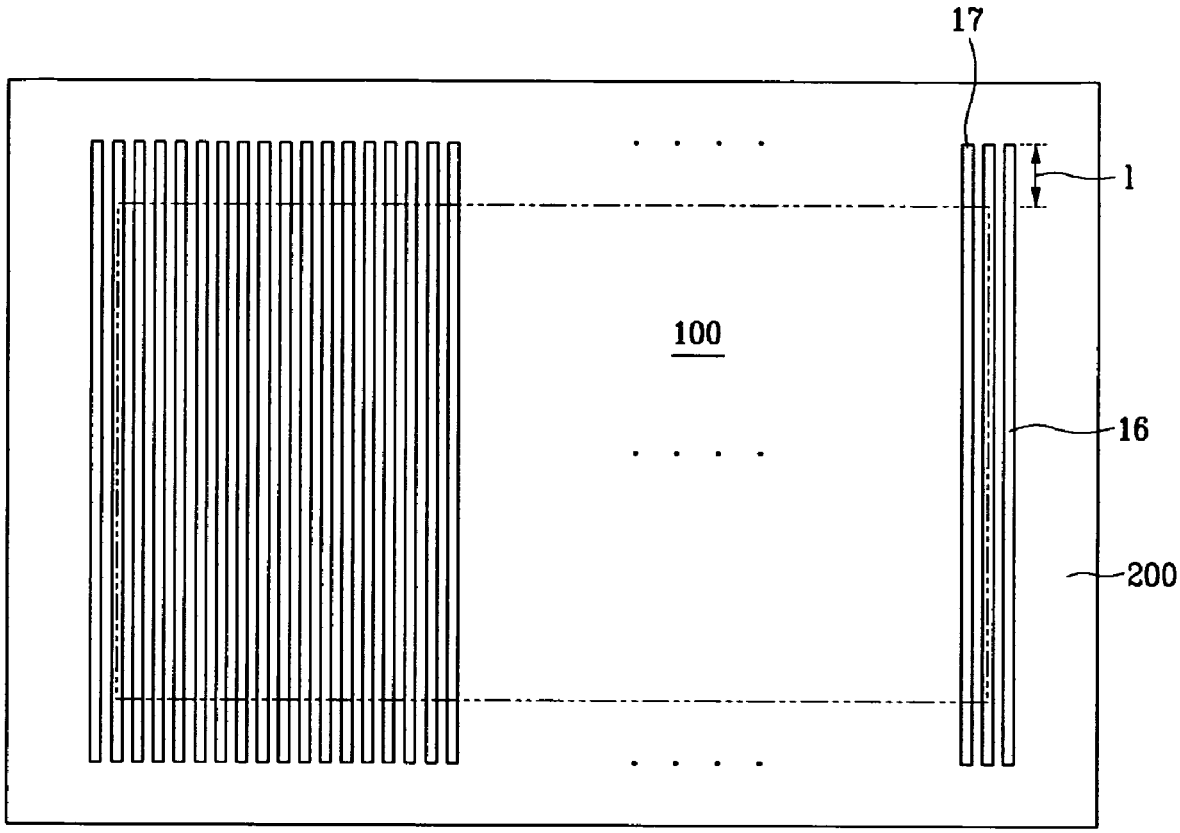
FIG. 3 is a plan view schematically showing the structure of barrier ribs and dummy barrier ribs of the PDP according to the first exemplary embodiment of the present invention.

FIG. 2 is a partially exploded perspective view showing the PDP according to the first exemplary embodiment of the present invention, and FIG. 3 is a plan view schematically showing the structure of barrier ribs and dummy barrier ribs of the PDP according to the first exemplary embodiment of the present invention.

Referring to FIG. 2, address electrodes 12 are arranged along the first direction (y-axis direction of the drawing) on an inner surface of the rear substrate 10, and a dielectric layer 14 covers the address electrodes 12. The address electrodes 12 are substantially parallel to each other.

Display electrodes 21 and 22 are arranged on an inner surface of the front substrate 20 in the second direction intersecting the address electrodes 12 (in the x-axis direction of the drawing). Each display electrode 21 and 22 includes bus electrodes 21*b* and 22*b* and extension electrodes 21*a* and 22*a*, respectively. The bus electrodes 21*b* and 22*b* extend along the first direction, and the extension electrodes 21*a* and 22*a* extend from the bus electrodes 21*b* and 22*b* toward centers of the respective discharge cells. Here, the bus electrodes 21*b* and 22*b* may be metal electrodes, and the extension electrodes 21*a* and 22*a* may be transparent electrodes, e.g., indium tin oxide (ITO) electrodes.

A dielectric layer 24 and a protective layer 26 are sequentially formed on the front substrate 20 to cover the display electrodes 21 and 22. The protective layer 26, which may be a magnesium oxide (MgO) layer, protects the dielectric layer 24 against collision with ions ionized during plasma discharge and improves discharge efficiency because of its high secondary electron emission coefficient.

Referring to FIG. 2 and FIG. 3, barrier ribs 16 and dummy barrier ribs 17 are arranged between the rear substrate 10 and the front substrate 20.

The barrier ribs 16 extend substantially parallel to the address electrodes 12, and they are formed in the display region 100 and define discharge cells 18.

Phosphor layers 19, which absorb UV rays and emit visible light, are formed on sides of the barrier ribs 16 and on the dielectric layer 14 within the discharge cells 18. The discharge cells 18 are filled with discharge gas (for example, a mixed gas of Xe and Ne) to cause plasma discharge.

The dummy barrier ribs 17, which extend from the barrier ribs 16, are formed in the non-display region 200. In the illustrative embodiment, the barrier ribs 16 and the dummy barrier ribs 17 may be formed by a dispensing method.

A dispensing method (also called a "nozzle spraying method") for manufacturing barrier ribs and dummy barrier ribs will now be described.

Figure 4:
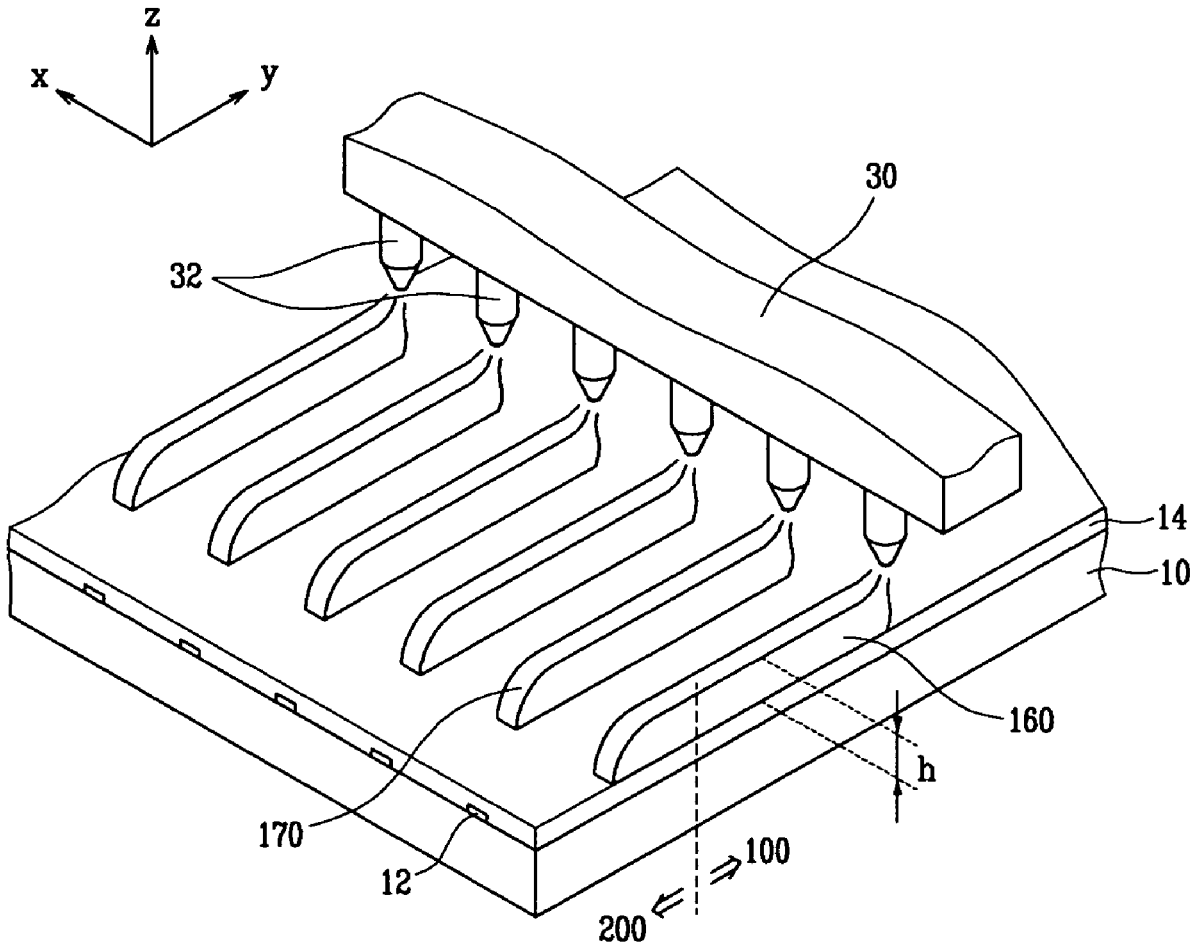
FIG. 4 is a perspective view showing a method for manufacturing the barrier ribs of the PDP according to the first exemplary embodiment of the present invention.
Figure 5:
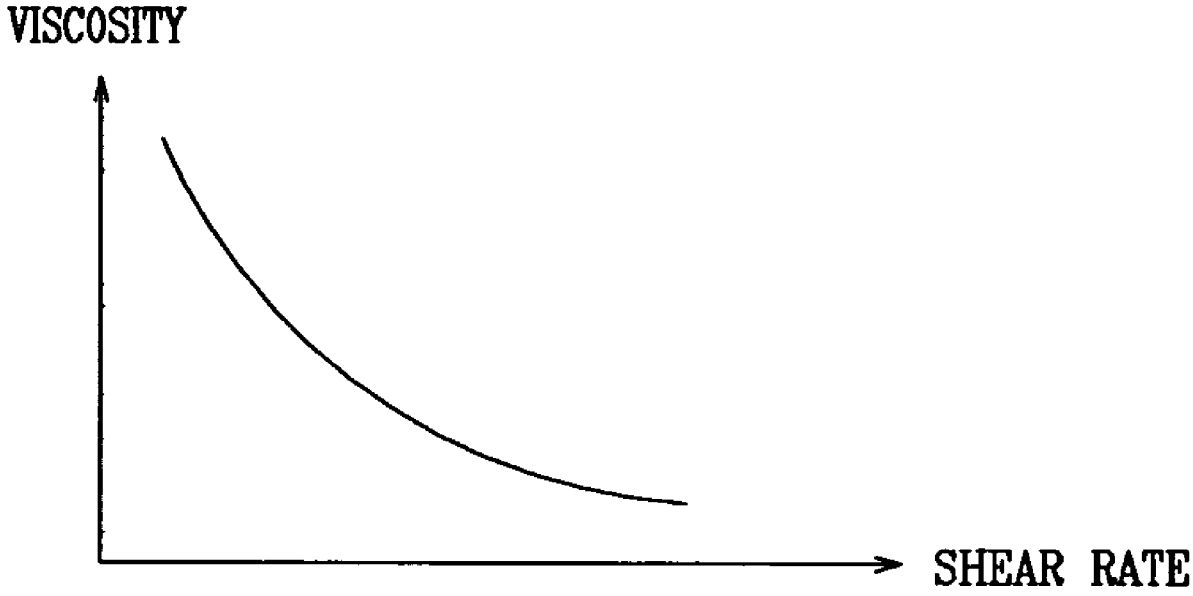
FIG. 5 is a graph showing the relationship between shear rate and viscosity of rib paste.

FIG. 4 is a perspective view showing a method for manufacturing the barrier ribs of the PDP according to the first exemplary embodiment of the present invention, and FIG. 5 is a graph showing the relationship between shear rate and viscosity of rib paste.

Referring to FIG. 4 and FIG. 5, a rib paste is prepared, and the viscosity of the rib paste may decrease as its shear rate increases.

A dispenser 30 dispenses rib paste to form the barrier ribs.

The dispenser 30 is positioned above the rear substrate 10 having the address electrodes 12 and the dielectric layer 14, and is then moved while discharging the rib paste through nozzles 32, thereby forming rising portions 170 and flat portions 160 of barrier ribs on the dielectric layer 14.

In the illustrative embodiment, a plurality of nozzles 32 are arranged in the dispenser 30 in a line and are spaced a predetermined distance apart from one another. The dispenser 30 moves in a direction parallel to the address electrodes 12 (in the y-axis direction of the drawing) to form the rising portions 170 and the flat portions 160 extending parallel to the address electrodes 12.

While a method of manufacturing barrier ribs and dummy barrier ribs formed parallel to address electrodes in a striped pattern is shown and described with reference to the illustrative embodiment of the present invention, the invention is not limited thereto. A wide variety of barrier ribs and dummy barrier ribs may be manufactured with varying arrangements and moving patterns of nozzles.

Figure 6A:
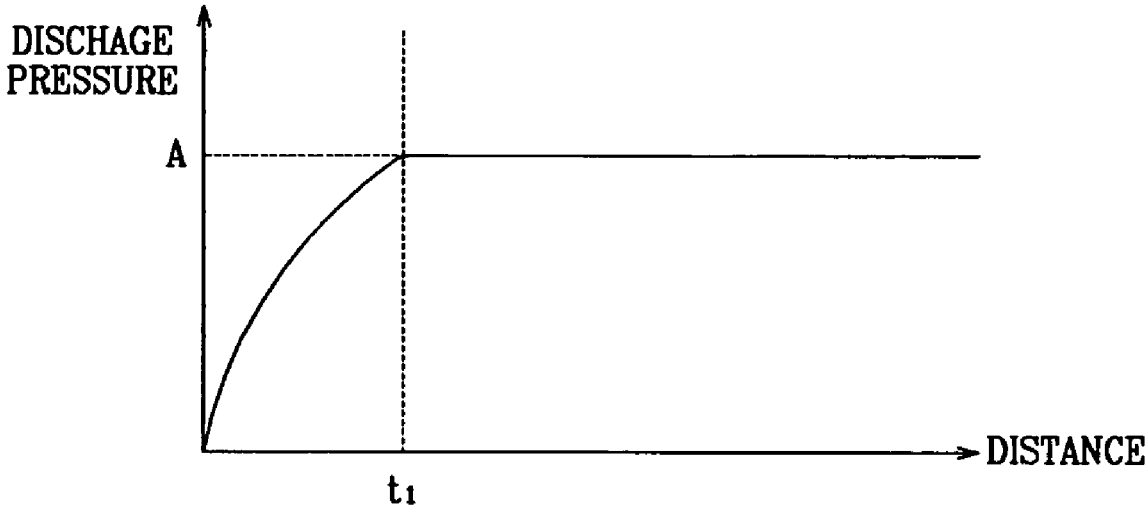
FIG. 6A is a graph showing paste discharge pressure depending on dispensing distance.

A process of forming the rising portions 170 and the flat portions 160 will now be described in greater detail with reference to FIG. 6A and FIG. 6B. FIG. 6A is a graph showing discharge pressure over discharge distance, and FIG. 6B is a graph showing barrier rib height over discharge distance.

Figure 6B:
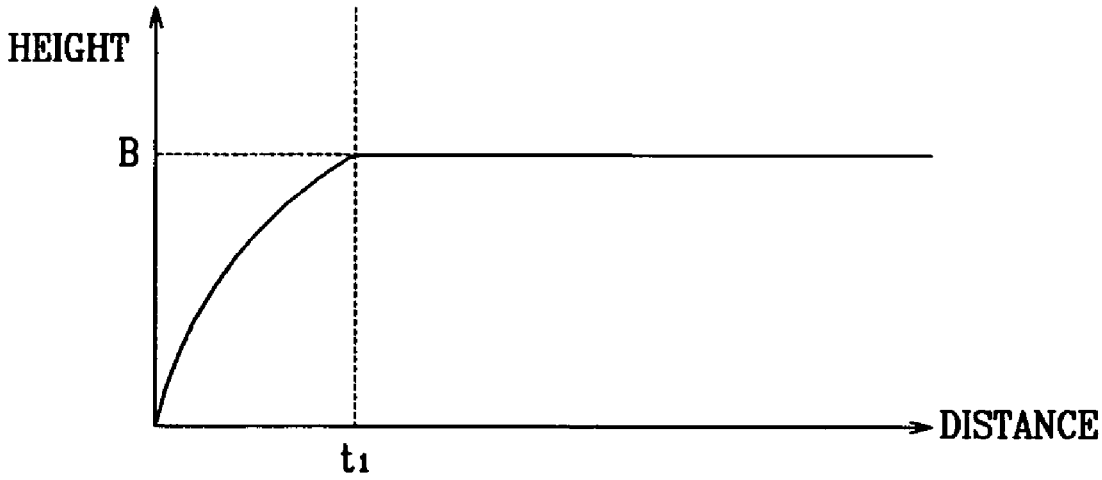
FIG. 6B is a graph showing barrier rib height depending on paste discharge distance.

Referring to FIG. 6A and FIG. 6B, the process of forming the rising portions 170 and the flat portions 160 includes forming the rising portions 170 while gradually increasing heights of the rising portions 170 at an initial rib paste discharge stage and forming the flat portions 160 having a substantially uniform height.

Specifically, at the initial rib paste discharge stage, the rising portions 170 are formed while gradually increasing the heights thereof. This is because a discharge pressure gradually increases from a start point up to a predetermined dispensing distance t1 by virtue of intrinsic characteristics of the dispensing method, as shown FIG. 6A and FIG. 6B. At this step, the rising portions 170 may be formed to be positioned in the non-display region 200.

In the step of forming the flat portions 160 having a substantially uniform height, as shown in FIG. 6A and FIG. 6B, the discharge pressure is kept constant after the predetermined dispensing distance t1, so that the flat portions 160 may have a substantially uniform height. At this step, the flat portions 160 are formed to be positioned in the display region 100.

In the illustrative embodiment, since the rising portions 170 having gradually increasing heights are formed in the non-display region 200, the flat portions 160 having a substantially uniform height are formed in the display region 100. Accordingly, gradually increasing the heights of the rising portions 170 at the initial discharge stage stabilizes the subsequent step of forming the flat portions 160 having a substantially uniform height.

As described above, the viscosity of the rib paste used in the present invention decreases as its shear rate increases, as shown in FIG. 5. When discharged through a nozzle 32, the rib paste has a high shear rate. Thus, when the rib paste is discharged through the nozzle, its viscosity is low and rising portions may be formed in a predetermined shape. Once the rising portions are formed on the substrate, the rib paste forming the flat portions has a low shear rate and high viscosity, enabling the flat portions to maintain the predetermined shape.

Next, the flat portions 160 positioned in the display region 100 and the rising portions 170 positioned in the non-display region 200 are dried and fired to complete the barrier ribs 16 and the dummy barrier ribs 17, respectively. Since the flat portions 160 positioned in the display region 100 have a substantially uniform height, the barrier ribs 16 also have a substantially uniform height.

To allow the barrier ribs 16 to be formed with a substantially uniform height in the display region 100, lengths of the dummy barrier ribs 17 should be optimized. An optimal range of the lengths of the dummy barrier ribs 17 will now be described.

In order to form the barrier ribs 16 having a substantially uniform height and to optimize an area of the non-display region 200, the barrier ribs 16 and the dummy barrier ribs 17 may be formed to satisfy the following requirement:

$$2.4 \leqq (h/l) \times 100 \leqq 6.0$$

where l is a length of the dummy barrier ribs 17 as measured in a direction parallel to the address electrodes 12 (in the y-axis direction of the drawing), and h is a height of the barrier ribs 16 as measured in a thickness direction of the panel (in the z-axis direction of the drawing).

If (h/l)×100 exceeds 6.0, rising portions having non-uniform heights may be positioned in the display region 100, thereby making the barrier ribs 16 have non-uniform heights. On the other hand, if (h/l)×100 is less than 2.4, the dummy barrier ribs may become too long, thereby undesirably increasing an area of the non-display region 200, which does not display images. In this case, l may be about 2 mm to about 5 mm considering a height of a PDP.

In the PDP according to an embodiment of the present invention, barrier ribs positioned in a display region can be formed to have a substantially uniform height while optimizing an area of a non-display region by optimally designing the height (h) of barrier ribs relative to the length (l) of dummy barrier ribs.

An embodiment of the present invention will now be described in more detail with reference to an experimental example. The following experimental example is provided for illustration only and not for limitation.

EXPERIMENTAL EXAMPLE

In this Experimental Example, barrier ribs are formed by a dispensing method. Heights (b) of barrier ribs are measured at various locations ranging from a starting point, that is, an end of the barrier ribs, to a distance (a). The measurement results are shown in Table 1. In the description of the Experimental Example, unless defined otherwise, the term 'barrier ribs' is used to mean in a broad sense both barrier ribs positioned in a display region and dummy barrier ribs positioned in a non-display region.

A height (b) of barrier ribs to be formed in a display region (that is, a height of barrier ribs measured in a thickness direction of the PDP) was set to 120 μm.

TABLE 1

| | a[mm] | | | | | | | | | | | |
|---|---|---|---|---|---|---|---|---|---|---|---|---|
| | 1.00 | 1.50 | 1.75 | 2.00 | 2.25 | 2.50 | 2.75 | 3.00 | 3.50 | 4.00 | 4.50 | 5.00 |
| b[μm] | 88 | 101 | 109 | 117 | 117 | 117 | 117 | 118 | 118 | 118 | 118 | 118 |

Table 1 shows that at a location less than 2.00 mm from the end of the barrier rib, heights are smaller than those of barrier ribs to be formed. Further, the heights of the formed barrier ribs were not uniform. Thus, in order to form a substantially uniform height of the barrier ribs in the display region, the dummy barrier ribs may be at least about 2.00 mm long.

Additionally, in order to optimize the area of the non-display region, the dummy barrier ribs may be not longer than about 5.00 mm.

In other words, the dummy barrier ribs may be about 2 mm to about 5 mm long. In the Experimental Example, since the height (h) of barrier ribs to be formed in the display region was set to 120 μm, the requirement expressed by $2.4 \leqq (h/l) \times 100 \leqq 6.0$ is satisfied, which suggests that barrier ribs have a substantially uniform height.

As described above, in the method for fabricating a PDP according to an embodiment of the present invention, a dispensing method is employed to form barrier ribs, thereby overcoming problems with conventional barrier rib manufacturing methods.

Additionally, embodiments of the present invention may provide an easier and faster process of forming barrier ribs. Thus, the productivity and throughput of PDPs can be enhanced.

A PDP according to an embodiment of the present invention enables barrier ribs positioned in a display region to be formed to have a substantially uniform height while optimizing an area of a non-display region by optimally designing the height of barrier ribs relative to the length of dummy barrier ribs.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of manufacturing a plasma display panel having discharge cells defined by barrier ribs between a first substrate and a second substrate opposing each other, and address electrodes and display electrodes correspond to respective discharge cells, the method comprising:

forming the barrier ribs on the first substrate, wherein forming a barrier rib comprises:

forming a rising portion and a flat portion using a dispenser that discharges rib paste while moving above the first substrate; and drying the rising portion and the flat portion.

2. The method of claim 1, wherein forming the rising portion and the flat portion comprises:

forming the rising portion while gradually increasing a height of the rising portion at an initial rib paste discharge stage, and forming the flat portion having a substantially uniform height.

3. The method of claim 1, wherein the barrier ribs are formed by the dispenser discharging the rib paste through a plurality of nozzles arranged in a line.

4. The method of claim 1, wherein the rising portion and the flat portion are formed extending along a direction in which the address electrodes extend.

5. The method of claim 1, wherein a viscosity of the rib paste decreases as its shear rate increases.

6. A plasma display panel comprising the barrier ribs formed by the method of claim 1.

7. The method of claim 1, wherein the address electrodes are arranged on the first substrate along a first direction, and forming the barrier rib satisfies the following formula:

$$2.4 \leqq (h/l) \times 100 \leqq 6.0$$

where l is a length of the rising portion measured in the first direction, and h is a height of the flat portion measured in a thickness direction of the plasma display panel.

8. The method of claim 7, wherein l is in a range of 2 mm-5 mm.

9. The method of claim 8, wherein h exceeds 20 μm.

10. The method of claim 1, wherein a height of the barrier rib exceeds 20 μm.

11. The method of claim 1, further comprising:

varying a discharge pressure of the dispenser while moving the dispenser from a starting point to a first point; and maintaining a constant discharge pressure of the dispenser while moving the dispenser from the first point to a second point after the first point.

12. The method of claim 11, wherein a display region and a non-display region of the plasma display panel abut each other at the first point.

13. The method of claim 11, wherein a distance from the starting point to the first point is in a range of 2 mm-5 mm.

* * * * *

UNITED STATES PATENT AND TRADEMARK OFFICE

CERTIFICATE OF CORRECTION

PATENT NO. : 7,604,524 B2
APPLICATION NO. : 11/217437
DATED : October 20, 2009
INVENTOR(S) : Jung et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 920 days.

Signed and Sealed this

Fourteenth Day of December, 2010

David J. Kappos

David J. Kappos
*Director of the United States Patent and Trademark Office*